US006591938B2

(12) United States Patent
Inoue et al.

(10) Patent No.: US 6,591,938 B2
(45) Date of Patent: Jul. 15, 2003

(54) SPEAKER DIAPHRAGM

(75) Inventors: Toshihide Inoue, Osaka (JP); Yushi Ono, Osaka (JP)

(73) Assignee: Onkyo Corporation (JP)

( * ) Notice: Subject to any disclaimer, the term of this patent is extended or adjusted under 35 U.S.C. 154(b) by 0 days.

(21) Appl. No.: 10/068,242

(22) Filed: Feb. 5, 2002

(65) Prior Publication Data

US 2002/0100635 A1 Aug. 1, 2002

Related U.S. Application Data

(63) Continuation of application No. 09/623,579, filed as application No. PCT/JP00/00391 on Jan. 26, 2000, now abandoned.

(30) Foreign Application Priority Data

Jan. 27, 1999 (JP) ..... 11-018791

(51) Int. Cl.[7] ..... G10K 13/00
(52) U.S. Cl. ..... 181/167; 181/157; 181/159
(58) Field of Search ..... 181/157, 167, 181/169

(56) References Cited

U.S. PATENT DOCUMENTS

| | | | | |
|---|---|---|---|---|
| 4,308,094 A | | 12/1981 | Miyoshi et al. | 162/218 |
| 4,416,934 A | * | 11/1983 | Kimura et al. | 442/195 |
| 4,428,996 A | | 1/1984 | Miyoshi et al. | 428/198 |
| 4,753,969 A | | 6/1988 | Mizone et al. | 523/211 |
| 4,919,859 A | | 4/1990 | Suda | 264/29.5 |
| 5,031,720 A | | 7/1991 | Ohta et al. | 181/169 |
| 5,102,729 A | | 4/1992 | Yamaguchi et al. | 428/290 |
| 5,206,466 A | * | 4/1993 | Inamiya | 181/169 |
| 5,329,072 A | | 7/1994 | Kageyama et al. | 181/167 |

* cited by examiner

*Primary Examiner*—Kim Lockett
(74) *Attorney, Agent, or Firm*—Amin & Turocy, LLP

(57) ABSTRACT

The speaker diaphragm of the present invention includes a nonwoven fabric impregnated with at least a thermosetting resin composition, molded, and cured. The nonwoven fabric is formed of a fiber material containing protein fibers. The thermosetting resin composition contains an unsaturated polyester resin as a main component. The speaker diaphragm of the present invention has excellent acoustic characteristics and is produced with high production efficiency.

15 Claims, 3 Drawing Sheets

SPEAKER DIAPHRAGM

This is a continuation of application Ser. No. 09/623,579, filed Sep. 6, 2000, now abandoned which is the U.S. national stage of PCT/JP00/00391, filed Jan. 26, 2000.

TECHNICAL FIELD

The present invention relates to a speaker diaphragm. More specifically, the present invention relates to a speaker diaphragm that has excellent acoustic characteristics and is produced with high production efficiency.

BACKGROUND ART

Conventionally, speaker diaphragms are known that can be obtained by impregnating a substrate with a thermosetting resin and subjecting the resultant substrate to molding and curing. Known substrates include a plain-woven fabric made of rigid reinforced fibers such as carbon fibers (CF) and glass fibers (GF), and a nonwoven fabric obtained by coating chopped pieces of fibers, such as CF and GF, with a resin and bonding the fibers randomly. As the impregnant thermosetting resin (matrix resin), an epoxy resin is known.

CF and GF used for the substrate have a large modulus of elasticity but are rigid and have extremely small internal loss. The epoxy resin as the matrix resin has little toughness and internal loss. Therefore, the conventional speaker diaphragm obtained by this combination of the substrate and the matrix resin generates large and sharp resonance. This type of speaker diaphragm is therefore insufficient for use for a full-range speaker. If a woven fabric is used as the substrate, there arise the problems that the physical properties of the diaphragm are likely to change depending on the directionality of the weaving of the woven fabric (anisotropy in the longitudinal and lateral directions) and that a texture of the fabric may be non-uniformly deformed during molding, resulting in non-uniform acoustic characteristics.

Another speaker diaphragm that has been proposed is formed by fusing thermoplastic resin fibers by heat pressing. However, this proposal has the problems that since a thermoplastic resin has a low modulus of elasticity, it is difficult to obtain a diaphragm with good properties (for example, a high Young's modulus), and that the heat resistance is insufficient.

In order to solve the above problems, a diaphragm has recently been developed, that is produced by binding a nonwoven fabric made of organic fibers having a high modulus of elasticity with a matrix resin or a binder. In this way, attempts to improve the characteristics (for example, the internal loss) of the diaphragm have been increasingly actively made.

However, the diaphragm obtained from a nonwoven fabric made of organic fibers having a high modulus of elasticity has the problems that, because the strength of the nonwoven fabric is low, its handling is not easy and the acoustic characteristics fail to be uniform.

Known methods for forming a nonwoven fabric from the organic fibers having a high modulus of elasticity, include the chemical bonding method and the needle punching method. The chemical bonding method tends to generate wrinkles and cracks, causing the problem of insufficient acoustic characteristics. The needle punching method possesses the problem that the physical properties of the resultant diaphragm may depend on the direction of webs constituting the nonwoven fabric. A filler may be added to the matrix resin or the binder as required. However, the conventional combination of the matrix resin and the filler fails to provide a sufficient internal loss and increases the density of the diaphragm. Moreover, as is well known, the workability of the matrix resin used for the diaphragm is poor.

As described above, conventional speaker diaphragms have problems yet to be solved with regard to acoustic characteristics such as the modulus of elasticity and the internal loss, as well as with regard to production efficiency.

The present invention has been made to solve the above conventional problems. An object of the invention is to provide a speaker diaphragm that has excellent acoustic characteristics and is produced with high production efficiency.

DISCLOSURE OF THE INVENTION

The speaker diaphragm of the present invention has one or two or more layers of nonwoven fabric, the nonwoven fabric layer being impregnated with a thermosetting resin composition, molded, and cured, wherein at least one of the nonwoven fabric layers is formed of nonwoven fabric made of a fiber material containing protein fibers, and the thermosetting resin composition contains an unsaturated polyester resin as a main component.

In a preferred embodiment, the protein fibers are silk fibers made of a natural silk, in which sericin has been substantially removed from the outer surface.

In a preferred embodiment, the content of the sericin in the silk fibers is 1% by weight or less.

In a preferred embodiment, the fineness of the silk fibers is 0.8 to 1.2 denier.

In a preferred embodiment, the speaker diaphragm has a plurality of nonwoven layers and the plurality of nonwoven fabric layers include a nonwoven fabric layer formed of the silk fibers and a nonwoven fabric layer formed of organic fibers having a high modulus of elasticity.

In a preferred embodiment, the organic fibers having a high modulus of elasticity are meta-aramid fibers.

In a preferred embodiment, in the speaker diaphragm of the present invention, the nonwoven fabric layer formed of the silk fibers and the nonwoven fabric layer formed of the organic fibers having a high modulus of elasticity are layered alternately.

In a preferred embodiment, the nonwoven fabric is meshed.

In a preferred embodiment, the thermosetting resin composition contains a scaly mineral.

In a preferred embodiment, the scaly mineral is graphite.

In a preferred embodiment, the graphite has a mean grain diameter in a range of 4 to 10 $\mu$m.

In a preferred embodiment, the scaly mineral is contained in a range of 20 to 50 parts by weight for 100 parts by weight of the unsaturated polyester resin.

In a preferred embodiment, the thermosetting resin composition further contains microbaloons.

In a preferred embodiment, the microbaloons are selected from organic microbaloons containing a vinylidene chloride-acrylonitrile copolymer as a main component and inorganic microbaloons containing borosilicate glass as a main component.

In a preferred embodiment, the microbaloons are contained in a range of 5 to 20 parts by weight for 100 parts by weight of the unsaturated polyester resin.

BEST MODE FOR CARRYING OUT THE INVENTION

Figure 1:
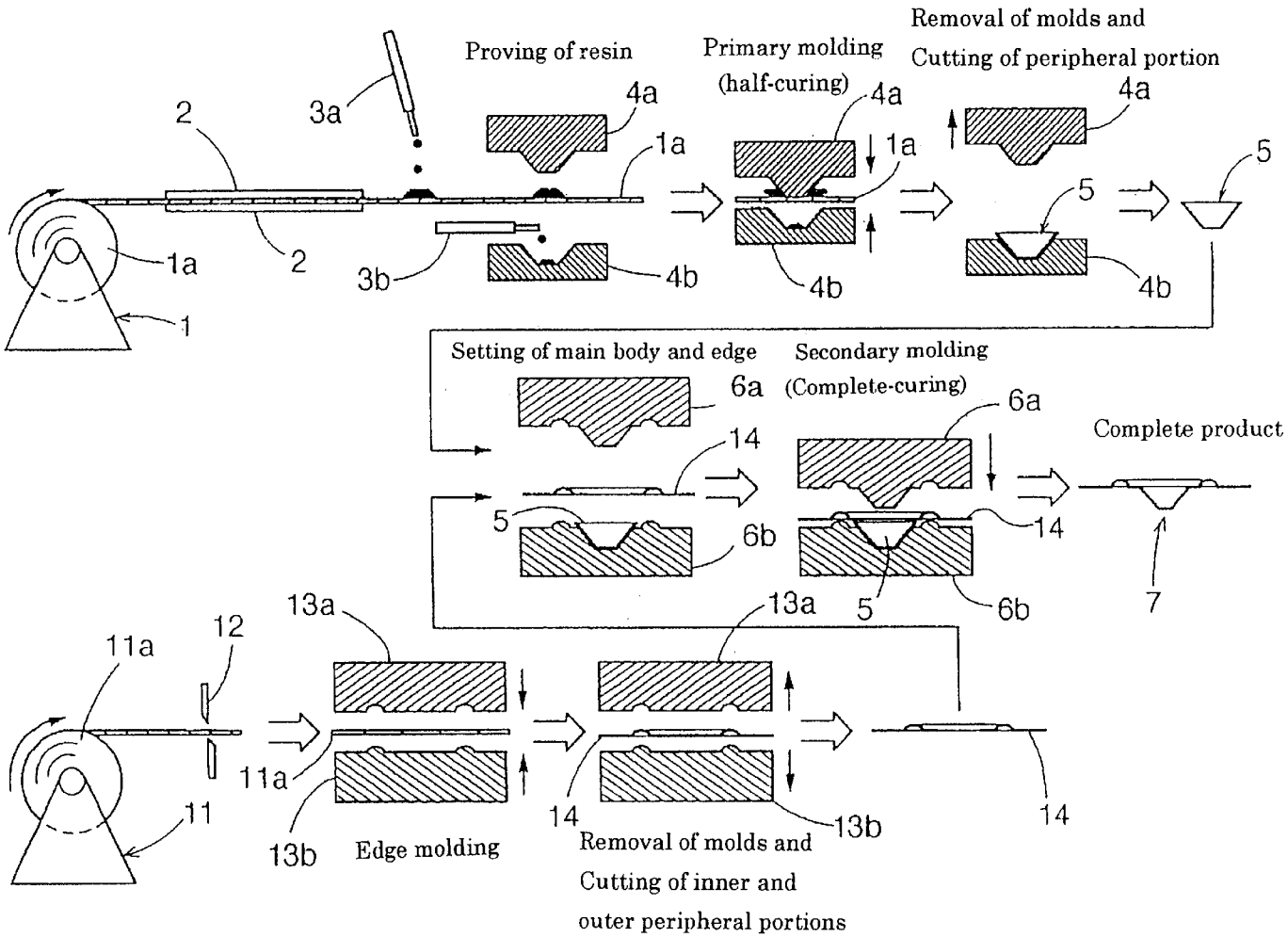
FIG. 1 is a schematic view illustrating the production process of a speaker provided with a diaphragm of the present invention.

The speaker diaphragm of the present invention has a substrate made of one or more layers of nonwoven fabric. The speaker diaphragm is obtained by impregnating the substrate made of the layers of nonwoven fabric with a thermosetting resin composition, and subjecting the impregnated substrate to molding and curing. At least one of the nonwoven fabric layers is formed of a fiber material containing protein fibers. In the case of a single nonwoven fabric layer, therefore, this single nonwoven fabric layer is formed of a fiber material containing protein fibers.

The nonwoven fabric layer formed of a fiber material containing protein fibers may be formed of only protein fibers or made of a fiber material containing protein fibers and other fibers. The protein fibers typically include natural silk fibers and wool fibers. Natural silk fibers are especially advantageous. More preferably, the silk fibers are made of a natural silk, in which sericin has been substantially removed from the outer surface thereof. The term "substantially removed" as used herein refers to the state where the content of sericin in the silk fibers is 1% by weight or less. It is generally known that sericin is contained in silk fibers in an amount of 20% by weight in the state of a cocoon and 17 to 18% by weight in the state of raw silk fibers. Sericin is removed from the silk fibers by any appropriate method (for example, by boiling with alkalescent hot water). By using the sericin-free silk fibers, a speaker diaphragm having excellent acoustic characteristics is obtained. The fineness of the silk fibers is preferably 0.8 to 1.2 denier (fiber diameter: 9.5 to 11.7 $\mu$m). Silk fibers whose size is in the above range have outstanding flexibility, formability, and operability, have a high modulus of elasticity, and can be well impregnated with an unsaturated polyester resin. The other fibers mentioned above include any appropriate fibers such as carbon fibers (CF) and glass fibers (GF).

The nonwoven fabric is formed by any appropriate method, using the above fiber material. Typical methods for forming the nonwoven fabric include the fluid intertwining method using a liquid such as water, or a gas, such as the air, and a method where the fiber material is mechanically intertwined randomly. The fluid intertwining method is preferable, considering that this method provides a nonwoven fabric having a uniform modulus of elasticity and good moldability. For example, the nonwoven fabric can be obtained by collecting the fiber material randomly by the dry method using air flow to form an accumulation layer and then intertwining the fibers in the accumulation layer with one another by the water flow intertwining method. The METSUKE (weight per unit area) of the nonwoven fabric used in the present invention is typically 30 to 150 g/m$^2$ although it may vary depending on the use. Many products of nonwoven fabrics produced by the water flow intertwining method are commercially available.

In another embodiment, the speaker diaphragm of the present invention has two or more (a plurality of) layers of nonwoven fabrics, and these nonwoven fabric layers are impregnated with a thermosetting resin composition and cured.

The number of nonwoven fabric layers may be determined as appropriate depending on the use. Typically, it is 3 to 6. At least one of the plurality of nonwoven fabric layers is constructed of the nonwoven fabric made of the fiber material containing protein fibers described above. In other words, all of the plurality of nonwoven fabric layers may be constructed of the nonwoven fabric made of a fiber material containing protein fibers, or some of the plurality of nonwoven fabric layers may be constructed of the nonwoven fabric made of a fiber material containing protein fibers.

Preferably, the plurality of nonwoven fabric layers is constructed of a multilayer structure composed of at least one nonwoven fabric layer made of the silk fibers described above (hereinafter, referred to as a "silk fiber nonwoven fabric layer") and at least one nonwoven fabric layer made of organic fibers having a high modulus of elasticity (hereinafter, referred to as an "organic nonwoven fabric layer"). Preferably, the silk fiber nonwoven fabric layer and the organic nonwoven fabric layer are stacked alternately. In the stacking of the nonwoven fabric layers, the orientation of the nonwoven fabrics is preferably sequentially shifted by an appropriate angle (for example, 30° ) when viewed along the normal of the nonwoven fabrics. This is done because directionality (anisotropy) is not completely eliminated even in nonwoven fabrics. The shift angle may be determined as appropriate depending on the kind of the nonwoven fabric. By shifting the orientation of the nonwoven fabrics during stacking, the orientation properties of the fibers of the nonwoven fabrics can be cancelled with each other. As a result, deformation during molding can be prevented.

Preferably, the nonwoven fabric is meshed, regardless of whether it is made of silk fibers or of organic fibers having a high modulus of elasticity. The mesh size (for example, the coarseness of the meshes and the shape of each mesh) may change as appropriate depending on the use. For example, a meshed nonwoven fabric of #16 mesh may be produced.

Examples of organic fibers having a high modulus of elasticity include meta-aramid fibers and para-aramid fibers. Typical examples of the meta-aramid fiber include poly (meta-phenylene isophthalamide) fiber. Typical examples of the para-aramid fiber include an aromatic polyamid fiber, such as co-para-phenylene-3,4'-oxydiphenylene terephthalamide fiber and poly(para-phenylene terephthalamide (PPTA) fiber, and a polyethylene terephthalate (PET) fiber. The meta-aramid fiber is preferable because it has a modulus of elasticity dose to that of the silk fiber.

The thermosetting resin composition serving as the impregnant for the above nonwoven fabric includes an unsaturated polyester resin as the main component. In the present invention, any appropriate unsaturated polyester resin may be used depending on the use.

Preferably, the thermosetting resin composition contains a scaly mineral as a filler. Typical examples of scaly minerals include graphite, mica, and talc. Graphite is preferable, because it has good conductivity and lubricity, and has good dispersibility when it is used as a filler. The mean grain diameter of the scaly mineral (it means the mean length of the longest portions of scales in this specification) is preferably about 4 to 10 $\mu$m. If the mean grain diameter is less than about 4 $\mu$m, the effect as a filler is likely to be insufficient. If the mean grain diameter exceeds about 10 $\mu$m, effective reinforcement is not obtained in many cases, because the filler fails to enter gaps among the nonwoven fibers during impregnation. The scaly mineral is contained in the range of about 20 to 50 parts by weight for 100 parts by weight of an unsaturated polyester resin. If the content is less than about 20 parts by weight, the Young's modulus (Young's modulus of elasticity) tends to be insufficient. If the content exceeds about 50 parts by weight, the scaly mineral hardly enters the gaps among the nonwoven fibers, resulting in being deposited on the surface of the nonwoven fabric and dropping off. It is therefore useless to include such a large amount of scaly mineral.

Preferably, the thermosetting resin composition further contains microbaloons. The microbaloons as used herein generically refer to hollow spheres. The microbaloons can be inorganic microbaloons or organic microbaloons. The inorganic microbaloons typically contain borosilicate glass as the main component. The organic microbaloons typically contain vinylidene chloride-acrylonitrile copolymer as the main component. The absolute specific gravity of the inorganic microbaloons is about 0.3 g/cm$^3$, and that of the organic microbaloons is about 0.02 g/cm$^3$. Both are suitable as the filler of the speaker diaphragm. The grain diameter of the microbaloons is typically about 40 to 60 $\mu$m. The microbaloons are contained in the range of about 5 to 20 parts by weight for 100 parts by weight of an unsaturated polyester resin. If the content is less than about 5 parts by weight, the internal loss tends to be insufficient. If the content exceeds about 20 parts by weight, the Young's modulus tends to be insufficient.

The thermosetting resin composition further contains various additives as required. Typical examples of such additives include a curing agent, a low profile agent, a pigment, and a reinforcing material.

Examples of the curing agent include polymerization initiators such as organic peroxides and cross-linking agents such as vinyl monomers. Examples of the low profile agent include thermoplastic resins and solutions thereof. As the pigment, any appropriate color pigments may be used depending on the use. A black pigment is often used for the speaker diaphragm.

Examples of the reinforcing material include mica, carbon fiber, and whisker.

The grain diameter of the mica may vary depending on the use (for example, the thickness of the resultant diaphragm). For example, if the thickness of the target diaphragm is about 0.3 mm, the mean grain diameter of the mica is suitably about 10 $\mu$m with a grain diameter distribution of about 5 to 25 $\mu$m. When the grain diameter of the mica is greater, the modulus of elasticity is greater. However, if the grain diameter is too great, the mica fails to be dispersed uniformly in the nonwoven fabric during molding due to the size of its grains. This results in different portions of the diaphragm having different rigidity, adversely affecting the acoustic characteristics of the diaphragm. The content of the mica may change depending on the grain diameter of the mica and the like. In consideration of the acoustic characteristics, the content is preferably in the range of about 15 to 25 parts by weight for 100 parts by weight of an unsaturated polyester resin if the mean grain diameter of the mica is about 5 $\mu$m. The reason is as follows. When the content of the mica is greater, the modulus of elasticity is greater. If the mean grain diameter of the mica is about 5 $\mu$m, up to about 50 parts by weight of the mica can be dispersed uniformly in 100 parts by weight of a resin. If an extremely large amount of mica is contained, the weight of the diaphragm increases, and the mica fails to be dispersed uniformly in the nonwoven fabric due to the larger mass of mica, but accumulates during molding. As a result, regarding the acoustic characteristics, the sound pressure lowers, and energy is concentrated on a specific frequency, resulting in poor balance.

As the carbon fiber, a polyacrylonitrile (PAN) or pitch carbon filter is used. The effective fiber length of the carbon fiber is about 40 $\mu$m or less. If the fiber length exceeds about 40 $\mu$m, the carbon fiber fails to be dispersed uniformly in the thin diaphragm, which makes it difficult to obtain sufficient properties (for example, smoothness). In practice, the minimum fiber length is about 20 $\mu$m.

As the whisker, ceramic whisker (for example, aluminum borate whisker) is typically used. Preferably, the length of the whisker is about 30 $\mu$m or less, and the diameter thereof is about 1.0 $\mu$m or less). If the size of the whisker exceeds these values, the whisker fails to be dispersed uniformly in the thin diaphragm, which makes it difficult to obtain sufficient properties (for example, smoothness). In practice, the minimum whisker length is about 5 $\mu$m and the minimum whisker diameter is about 0.2 $\mu$m.

The speaker diaphragm of the present invention is obtained by impregnating the nonwoven fabric or the layered structure of nonwoven fabrics described above (this layered structure is also simply called the nonwoven fabric in the following description of the production method) with the thermosetting resin composition described above, and subjecting the resultant nonwoven fabric to molding with a mold and curing. An example of the production method of a speaker including the diaphragm of the present invention is described in the following.

FIG. 1 is a schematic view illustrating the molding process of a speaker including the diaphragm of the present invention.

First, a nonwoven fabric 1*a* is fed from a material feeder 1. Typically, the nonwoven fabric 1*a* is provided in the state of being rolled on the feeder 1, and fed out from the feeder 1 along with the flow of the process. In order to prevent the nonwoven fabric from deforming during molding, the fed nonwoven fabric 1*a* is supported movably at both sides with respect to the feeding direction with a clamp 2. Thereafter, a resin feed nozzle 3*a* feeds a thermosetting resin composition to the nonwoven fabric 1*a* and a resin feed nozzle 3*b* feeds the thermosetting resin composition to a lower mold 4*b*. The resin composition may be fed only to one surface of the nonwoven fabric 1*a*. Preferably, however, it is fed to both surfaces of the nonwoven fabric 1*a*, as shown in FIG. 1, to prevent the filler and the like from being unevenly distributed in one surface portion of the diaphragm. The nonwoven fabric 1*a* with the resin composition thereon is then heat-pressed, so that the resin composition is subjected to rolling and the entire nonwoven fabric 1*a* is impregnated with the resin composition. The impregnant resin is half-cured (primary molding). Then, the upper and lower molds are removed and the outer peripheral portion of the molded product is cut out, thus obtaining a speaker diaphragm 5.

The heating temperature and time (curing time) may be changed as appropriate depending on the kind of the thermosetting resin. Typically, the heating temperature is about 80 to 120° C., and the heating time is about 1 to 3 minutes. Also, the press pressure and the mold clearance may be changed as appropriate depending on the kind and amount of the thermosetting resin, the kind and density of the nonwoven fabric, the thickness of the target diaphragm, and the like. According to the present invention, the typical press pressure is about 10 to 40 kg/cm$^2$ and the typical mold clearance (corresponding to the thickness of the target diaphragm) is about 0.5 to 1.2 mm.

An edge material 11*a* is fed from an edge material feeder 11. The edge material 11*a* is also provided in the state of being rolled onto the feeder 11, and fed out from the feeder 11 along with the flow of the process. The edge material 11*a* is then cut to an appropriate length with a cutting blade 12. Thereafter, the edge material 11*a* is molded by heat pressing with an upper mold 13*a* and a lower mold 13*b*. Then, the upper and lower molds are removed and the inner and outer peripheral portions of the molded product are cut out, thus obtaining an edge portion 14. The heating temperature and time, the press pressure, and the mold clearance may be set appropriately depending on the kind of the edge material and the type of the target edge portion.

The speaker diaphragm 5 and the edge portion 14 are placed in position between an upper mold 6*a* and a lower mold 6*b*, and heat-pressed to completely cure the thermosetting resin and simultaneously integrate the edge portion with the diaphragm (secondary molding). The heating temperature and time, the press pressure, and the mold clearance may be set to appropriate conditions. Finally, the upper and lower molds are removed and the molded product is cut to make a center hole, thus obtaining a speaker 7.

In the above embodiment, the resin composition was applied by pressing using a mold. Other application methods such as spray application and blade application may also be used. The resin composition is preferably applied on both surfaces of the nonwoven fabric as described above. In particular, the effect of this dual-surface application is conspicuous when the resin composition contains a scaly mineral (for example, graphite). The reason for this is as follows. The application of the resin composition on both surfaces of the nonwoven fabric produces high-strength graphite layers on both surfaces of the nonwoven fabric during molding. With such graphite layers sandwiching the nonwoven fabric during molding, strength anisotropy that has been observed to some extent in the nonwoven fabric decreases after the molding. Moreover, the existence of the high-strength graphite layers on both surfaces improves both the internal loss and the Young's modulus.

In the above embodiment, the thermosetting resin for the diaphragm was cured at two stages, namely a primary molding and a secondary molding. If the edge portion is produced beforehand, the curing and molding of the diaphragm and the integration of the diaphragm with the edge portion can be performed simultaneously.

The speaker diaphragm of the present invention can be used for any speaker (for example, a speaker for bass, midrange, or treble). The diaphragm can be of any appropriate shape (for example, a shape of a cone, a dome, or a flat plate).

Hereinafter, the function of the present invention will be described.

According to the present invention, a speaker diaphragm having excellent acoustic characteristics is obtained by using a nonwoven fabric made of a fiber material containing protein fibers. Protein fibers have outstanding vibration damping ability and can clearly distinguish among a fundamental tone, a harmonic, and a triple harmonic. Moreover, according to the present invention, the nonwoven fabric is impregnated with an unsaturated polyester resin composition. This makes it possible to produce a speaker diaphragm with excellent workability while maintaining the prominent characteristics of the protein fibers. The unsaturated polyester resin composition is advantageous over an impregnant resin (for example, an epoxy resin) used for conventional speaker diaphragms in that (i) the curing is ramarkably fast, (ii) the viscosity is low, (iii) low-temperature molding is possible, (iv) preparation of a prepreg is unnecessary, and (v) an additive can be easily added. In addition, the unsaturated polyester resin that is cured at a low temperature can be used in combination with the protein fiber. In comparison, it is quite difficult to use conventional impregnant resins (epoxy resins) in combination with protein fibers because the protein fiber tends to degrade at typical curing temperatures (for example, 150° C.) for the impregnant resin. Thus, according to the present invention, by using protein fibers and the unsaturated polyester resin in combination, a speaker diaphragm having excellent acoustic characteristics can be obtained with significantly high production efficiency.

In a preferred embodiment, used as the protein fibers are silk fibers made of a natural silk, in which sericin has been substantially removed from the outer surface thereof. By using such silk fibers, the acoustic characteristics can be further improved. The reason is as follows. Silk fibers are made of fibroin fibers having a roughly triangular section covered with sericin. The fibroin fibers intrinsically have a tendency of easily tying together tightly during molding, are flexible, and have a high modulus of elasticity. However, in normal silk fibers, which have sericin on the outer surface thereof covering each of the fibroin fibers, the sericin serves as a binder binding the fibroin fibers, thereby blocking the fibroin fibers from tying together during molding. Removing the sericin, therefore, allows the fibroin fibers to tie together tightly without being blocked by the sericin sterically. As a result, the modulus of elasticity of the resultant nonwoven fabric improves significantly. Also, the effect of the outstanding vibration damping ability possessed by the fibroin fibers (protein fibers) can be exhibited sufficiently and efficiently. Furthermore, when the thus-obtained nonwoven fabric having the tightly tying structure is impregnated with a thermosetting resin of the same amount as that used for the conventional nonwoven fabric, the fiber volume ratio becomes high compared with conventional nonwoven fabrics. The resultant diaphragm exhibits more effectively the characteristics of the fibroin fibers, that is, being flexible and having a high modulus of elasticity. This, therefore, makes it possible to provide a speaker diaphragm having a high modulus of elasticity and excellent acoustic characteristics. The above function can be satisfactorily exhibited if the sericin is removed to such a degree that the sericin content in the silk fibers is 1% by weight or less. If the fineness of the silk fibers is in the range of about 0.8 to 1.2 denier, the above flexibility and modulus of elasticity, as well as the formability into the nonwoven fabric, are especially good. Moreover, since the nonwoven fabric formed of such fine fibers has large inner spacing, impregnation with an unsaturated polyester resin can be accomplished easily with outstanding workability.

In another aspect of the present invention, a plurality of nonwoven fabric layers are formed, allowing a resin to enter into gaps between the nonwoven fabric layers. This results in formation of layers having a large fiber density (corresponding to nonwoven fabric layers) and layers having a small fiber density (corresponding to resin layers formed between the nonwoven fabric layers) in the thickness direction of the layered structure. As a result, the layers having a large fiber density are slipped from each other in the thickness direction of the resultant speaker diaphragm, which advantageously increases the internal loss.

In a preferred embodiment, both a silk fiber nonwoven fabric layer and an organic nonwoven fabric layer are formed. This enables the excellent acoustic characteristics possessed by the silk fibers to be provided on the surface of the speaker diaphragm, and at the same time, enables the outstanding shape retaining property and mechanical strength derived from the outstanding tensile strength possessed by the organic fibers, which have a high modulus of elasticity, to be provided over the entire diaphragm. If the silk fiber nonwoven fabric layers and the organic nonwoven fabric layers are formed alternately, the acoustic characteristics and mechanical strength of the diaphragm can be further improved.

In a preferred embodiment, the nonwoven fabric is meshed. This prevents undesirable deformation during diaphragm molding, as described below in detail. The nonwoven fabric inevitably has a longitudinal to lateral strength ratio of 2 or more, due to the production method thereof. Because of this strength anisotropy, undesirable deformation (distortion) occurs during the diaphragm molding. For example, when the diaphragm is molded into a corn shape, the nonwoven fabric is normally stretched by about 20%. If the longitudinal to lateral strength ratio is 2 or more, the nonwoven fabric fails to be stretched uniformly, causing a distortion. It is therefore important to have a longitudinal to lateral strength ratio that is close to 1. If the nonwoven fabric is meshed, the meshes alleviate the stress generated during the molding (stretching) and also are responsible for most of the expansion and the contraction of the nonwoven fabric. As a result, the non-uniform deformation during the molding is efficiently prevented. It has been confirmed that, in practice, a difference in strength between the longitudinal and lateral directions is hardly observed (the longitudinal to lateral strength ratio is substantially 1), even when the nonwoven fabric is stretched by about 20%.

In a preferred embodiment, a scaly mineral is added to the thermosetting resin composition. This improves the Young's modulus, the internal loss, and the uniformity in deformation during molding. The scaly mineral has weak anisotropy compared with a needle filler, resulting in small distortion, and has a large friction coefficient compared with the needle filler, resulting in large internal loss. The scaly mineral also has outstanding dispersion property as the filler, and thus, effectively improves the Young's modulus. Preferably, the scaly mineral is graphite. Graphite is a carbon crystal having a layered structure, and has good conductivity and lubricity, thereby especially exhibiting outstanding slip and dispersion properties. For example, when the thermosetting resin composition is applied to the nonwoven fabric and press-molded, the applied thermosetting resin is compressed with a mold during the heat pressing, penetrating from the surface of the nonwoven fabric into the inside. Once the thermosetting resin reaches the back surface, it comes out from the nonwoven fabric and is cured outside. Also in such a case, graphite exhibits very good slip and dispersion properties.

In a preferred embodiment, the thermosetting resin composition further contains microbaloons. The use of the microbaloons makes it possible to reduce the weight of the diaphragm of the present invention maintaining its excellent characteristics. Typically, the microbaloons are organic microbaloons having a vinylidene chloride-acrylonitrile copolymer as the main component, or inorganic microbaloons having borosilicate glass as the main component. These microbaloons have an especially outstanding dispersion property, and therefore can be easily used together with other additives. This allows for a wide range of blends according to the use.

Hereinafter, the present invention is described in detail by way of examples. It should be noted that the present invention is not limited to these examples.

EXAMPLE 1

Silk staple fibers (fiber length: 58 mm; 1.2 denier, which also applies to subsequent examples) were randomly collected by the dry method using air flow to form an accumulation layer, and then the fibers were intertwined with one another mechanically by the water flow intertwining method, to produce a nonwoven fabric having a weight of 150 g/m$^2$. An unsaturated polyester solution a shown in Table 1 below was applied to the resultant nonwoven fabric at a density of about 125 to 150 g/m$^2$, and molded by heat pressing at 110° C. for one minute, to obtain a speaker diaphragm having a diameter of 16 cm and a thickness of 0.23 mm.

TABLE 1

| | (Unit: parts by weight) Solution | | | | | | | | |
|---|---|---|---|---|---|---|---|---|---|
| Component | a | b | c | d | e | f | g | h | i |
| Unsaturated polyester resin (Nippon Shokubai Co., Ltd.: N350L) | 100 | 100 | 100 | 100 | 100 | 100 | 100 | 100 | 100 |
| Low profile agent (NOF Corp.: MODIPER S501) | 5 | 5 | 5 | 5 | 5 | 5 | 5 | 5 | 5 |
| Curing agent (NOF Corp.: PEROCTA O) | 1.3 | 1.3 | 1.3 | 1.3 | 1.3 | 1.3 | 1.3 | 1.3 | 1.3 |
| Synthetic mica (Co-op Chemical Co., Ltd.: MK100) | — | 20 | — | — | — | — | — | — | — |
| Scaly graphite (Nippon Kokuen Ltd.: CSPE) Mean grain dia.: 4.5 μm | — | — | — | 40 | — | 20 | 20 | 20 | 20 |
| Scaly graphite (Nippon Kokuen Ltd.: CMX) Mean grain dia: 50 μm | — | — | 40 | — | — | — | — | — | — |

TABLE 1-continued

| Component | (Unit: parts by weight) Solution a | b | c | d | e | f | g | h | i |
|---|---|---|---|---|---|---|---|---|---|
| Earthy graphite (Nippon Kokuen Ltd.: AOP) Mean grain dia.: 4.0 μm | — | — | — | — | 40 | — | — | — | — |
| Hollow spheres (Nippon Ferrite KK: EXPANCEL 091DE) Mean grain dia.: 60 μm | — | — | — | — | — | — | 10 | 20 | — |
| Hollow spheres (Fuji Silysia Chemical Ltd.: Fuji Balloon H30) Mean grain dia.: 40 μm | — | — | — | — | — | — | — | — | 10 |

The Young's modulus, density, specific modulus of elasticity, internal loss, and fiber volume ratio of the resultant diaphragm were measured by normal methods. The results are shown in Table 2 below, together with the results of Examples 2 to 4 and Comparative Examples 1 to 3, which will be described later.

TABLE 2

| | Young's modulus $10^{10}$ dyn/cm$^2$ | Density g/cm$^3$ | Specific modulus of elasticity $10^{10}$ dyn · cm/g | Internal loss tan δ | Fiber Volume Ratio % |
|---|---|---|---|---|---|
| Example 1 | 3.8 | 1.25 | 3.04 | 0.023 | 38 |
| Example 2 | 4.1 | 1.22 | 3.36 | 0.028 | 51 |
| Comparative Example 1 | 2.5 | 1.26 | 2.05 | 0.020 | 31 |
| Example 3 | 4.5 | 1.22 | 3.69 | 0.034 | 50 |
| Example 4 | 6.3 | 1.37 | 4.60 | 0.035 | 45 |
| Comparative Example 2 | 2.8 | 1.24 | 2.26 | 0.022 | 33 |
| Comparative Example 3 | 2.1 | 1.22 | 1.72 | 0.020 | 50 |

EXAMPLE 2

A speaker diaphragm was obtained in the same manner as described in Example 1, except that silk fibers subjected to purification by boiling with alkalescent hot water to reduce the sericin content to 1% by weight or less were used. The resultant diaphragm was measured for the items described in Example 1. The results are shown in Table 2 above.

COMPARATIVE EXAMPLE 1

A speaker diaphragm was obtained in the same manner as described in Example 1, except that PET staple fibers (fiber length: 38 mm) were used. The resultant diaphragm was measured for the items described in Example 1. The results are shown in Table 2 above.

EXAMPLE 3

A speaker diaphragm was obtained in the same manner as described in Example 1, except that a layered nonwoven fabric was used. The layered nonwoven fabric was produced by preparing nonwoven fabrics having a weight of 30 g/m$^2$ by the use of silk fibers used in Example 2 and layering five of these nonwoven fabrics on one another, so that the orientation of the fabrics be sequentially shifted by 30 degrees when viewed from the top. The resultant diaphragm was measured for the items described in Example 1. The results are shown in Table 2 above.

EXAMPLE 4

A speaker diaphragm was obtained in the same manner as described in Example 1 except that an unsaturated polyester solution b shown in Table 1 above was applied to the layered nonwoven fabric used in Example 3 at a density of 125 to 150 g/m$^2$. The resultant diaphragm was measured for the items described in Example 1. The results are shown in Table 2 above.

COMPARATIVE EXAMPLE 2

A speaker diaphragm was obtained in the same manner as described in Example 1, except that the nonwoven fabric was produced by the needle punching method. The resultant diaphragm was measured for the items described in Example 1. The results are shown in Table 2 above.

COMPARATIVE EXAMPLE 3

Silk staple fibers (fiber length: 58 mm) were randomly collected by the dry method using air flow to form an accumulation layer, and then the fibers were intertwined with one another mechanically by the water flow intertwining method, to obtain a nonwoven fabric having a weight of 150 g/m$^2$. Three-layer prepreg sheets made of an epoxy resin (about 150 g/m$^2$) were thermally transferred to both surfaces of the nonwoven fabric, to form a nonwoven prepreg sheet. The sheet was then heat-pressed at 150° C. for 15 minutes, to obtain a speaker diaphragm. The resultant diaphragm was measured for the items described in Example 1. The results are shown in Table 2 above.

As is apparent from Table 2 above, all the diaphragms of Examples 1 to 4 using the silk fibers were superior in Young's modulus and internal loss to the diaphragms of Comparative Examples 1 to 3. It is also found from the results of Examples 2 to 4 that using sericin-free silk fibers further improves the Young's modulus and the internal loss. From the results of Examples 3 and 4, it is found that using layered nonwoven fabric significantly improves the fiber volume ratio and the internal loss.

It is apparent from the comparison of Examples 1 to 4 with Comparative Example 3 that the heat-press molding can be done in considerably shorter time by using the unsaturated polyester resin, as in the examples of the present invention, than by using the epoxy resin. This indicates that the speaker diaphragm of the present invention can be produced with much higher production efficiency than diaphragms using the epoxy resin. In addition, according to the present invention, the heat-press molding can be done at a considerably lower temperature than when using the epoxy resin. This prevents the silk fibers from being adversely influenced. As a result, the Young's modulus, the specific modulus of elasticity, and the internal loss are significantly superior to those of Comparative Example 3, which uses the epoxy resin. The silk fibers start decomposing at 120° C. and start generating ammonia at 130° C. Therefore, if the epoxy resin is used for heat pressing, the characteristics of the silk fibers will be degraded. In addition, according to the present invention, the operability during production is much better than in Comparative Example 3. This is because the epoxy resin is highly viscous at low temperature. Therefore, in order to allow for impregnation with a fixed amount of the epoxy resin, a complicated procedure (for example, applying the epoxy resin to a release sheet to a fixed thickness with a doctor blade and half-curing the resin: i.e., shifting to B stage) must be performed under difficult handling conditions. According to the present invention, this procedure is unnecessary. Moreover, if low-temperature molding is neccesary, adding various additives is difficult when the epoxy resin is used. Therefore, when the epoxy resin is used, purpose-specific characteristic improvement is difficult.

EXAMPLE 5

A silk fiber nonwoven fabric was produced in the same manner as in Example 2, except that the weight of the nonwoven fabric was 35 g/m$^2$. Another nonwoven fabric (weight: 70 g/m$^2$) was produced in the same manner as in Example 1, except that meta-aramid fibers (CONEX of Teijin Ltd., fiber length: 38 mm) were used. These nonwoven fabrics were layered to form a three-layer nonwoven fabric composed of two silk fiber nonwoven fabric layers and one aramid nonwoven fabric layer sandwiched by the two silk fiber nonwoven fabric layers. Subsequently, the procedure described in Example 1 was followed to obtain a speaker diaphragm.

The Young's modulus, density; specific modulus of elasticity, and internal loss of the resultant diaphragm were measured by normal methods. In addition, the deformation rate was calculated from the following expression.

$$\{(\text{major diameter}-\text{minor diameter})/(\text{normal size})\}\times 100$$

wherein the major diameter and the minor diameter represent the lengths of the major axis and minor axis, respectively, of the diaphragm that is deformed into an ellipse during molding. These results are shown in Table 3 below, together with the results of Examples 6 to 9, which will be described later.

TABLE 3

| | Young's modulus $10^{10}$ dyn/cm$^2$ | Density g/cm$^3$ | Specific Modulus of Elasticity $10^{10}$ dyn · cm/g | Internal loss tan δ | Deformation Ratio % |
|---|---|---|---|---|---|
| Example 5 | 4.5 | 1.20 | 3.75 | 0.031 | 7 |
| Example 6 | 25.0 | 1.20 | 20.8 | 0.030 | 15 |

TABLE 3-continued

| | Young's modulus $10^{10}$ dyn/cm$^2$ | Density g/cm$^3$ | Specific Modulus of Elasticity $10^{10}$ dyn · cm/g | Internal loss tan δ | Deformation Ratio % |
|---|---|---|---|---|---|
| Example 7 | 6.5 | 1.27 | 5.12 | 0.022 | 21 |
| Example 8 | 4.3 | 1.20 | 3.58 | 0.031 | 2 |
| Example 9 | 7.2 | 1.37 | 5.25 | 0.034 | <1 |

EXAMPLE 6

A speaker diaphragm was obtained in the same manner as described in Example 5, except that para-aramid fibers (Kevlar of Toray DuPont Co., Ltd., fiber length: 38 mm) were used in place of the meta-aramid fibers. The resultant diaphragm was measured for the items described in Example 5. The results are shown in Table 3 above.

EXAMPLE 7

A speaker diaphragm was obtained in the same manner as described in Example 5 except that PET fibers were used in place of the meta-aramid fibers. The resultant diaphragm was measured for the items described in Example 5. The results are shown in Table 3 above.

EXAMPLE 8

A meshed nonwoven fabric was produced by intertwining meta-aramid fibers under water flow using a #16-mesh support net. A speaker diaphragm was obtained in the same manner as described in Example 5, except that the above meshed nonwoven fabric was used. The resultant diaphragm was measured for the items described in Example 5. The results are shown in Table 3 above.

EXAMPLE 9

A speaker diaphragm was obtained in the same manner as in Example 8, except that the unsaturated polyester resin solution b was used in place of the unsaturated polyester resin solution a. The resultant diaphragm was measured for the items described in Example 5. The results are shown in Table 3 above.

As is apparent from Table 3 above, all the speaker diaphragms of Examples 5 to 9 exhibited excellent characteristics. For example, the diaphragm of Example 5 using the meta-aramid fibers has an especially excellent deformation rate, and the diaphragm of Example 6 using the para-aramid fibers has especially excellent Young's modulus and specific modulus of elasticity.

While the Young's modulus of the silk fibers is 8.8 to $13.8\times10^{10}$ dyn/cm$^2$, the Young's modulus of the meta-aramid fibers is $7.3\times10^{10}$ dyn/cm$^2$ and that of the para-aramid fibers is $5.8\times10^{11}$ dyn/cm$^2$. Also from these results, it is found preferable to combine nonwoven fabrics using fibers that are dose to each other in the Young's modulus. The Young's modulus of the PET fibers is $1.23\times10^{11}$ dyn/cm$^2$. For the reference, the three-layer structure using the meta-aramid fibers of Example 5 provides substantially the same properties as the five-layer structure of the silk fibers of Example 3 despite the fact that the number of layers is smaller. This indicates that the workability in the production of the speaker diaphragm is further improved by using the meta-aramid fibers.

As for the deformation rate during molding, it is found that deformation is advantageously reduced in particular when the meshed nonwoven fabric is used.

EXAMPLE 10

Silk staple fibers (fiber length: 58 mm) were randomly collected by the dry method using air flow to form an accumulation layer, and then the fibers were intertwined with one another mechanically by the water flow intertwining method, to obtain a nonwoven fabric having a weight of 30 g/m$^2$. A total of six of such nonwoven fabrics were layered on one another. The unsaturated polyester solution d shown in Table 1 above was applied to both surfaces of the resultant layered structure at a density of about 125 to 150 g/m$^2$, and heat-pressed at 110° C. for one minute using diaphragm-shaped matched die molds. As a result, a speaker diaphragm having a diameter of 20 cm and a thickness of 0.35 mm was obtained.

The Young's modulus, density, specific modulus of elasticity, internal loss, and deformation anisotropy of the resultant diaphragm were measured by normal methods. The deformation anisotropy is represented by a longitudinal to lateral stretching ratio during the molding. The results are shown in Table 4 below, together with the results of Examples 11 to 13, which will be described later.

Figure 2:
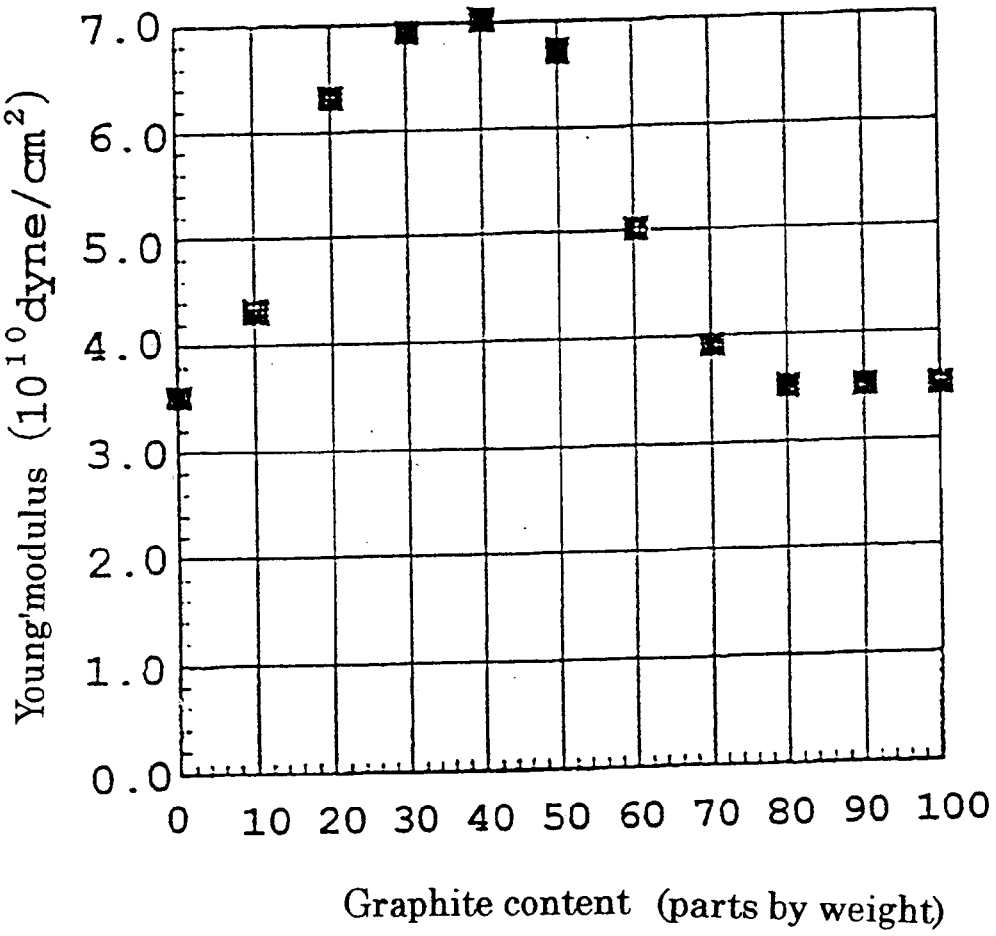
FIG. 2 is a graph showing the relationship between the graphite content in a thermosetting resin composition used in the present invention and the Young's modulus of the resultant product.

In addition, diaphragms were produced by varying the content of scaly graphite in the unsaturated polyester solution d, and the Young's modulus of the resultant diaphragms was measured. The relationship between the graphite content and the Young's modulus is shown in FIG. 2.

TABLE 4

| | Young's modulus $10^{10}$ dyn/cm$^2$ | Density g/cm$^3$ | Specific modulus of elasticity $10^{10}$ dyn · cm/g | Internal loss tan δ | Longitudinal/lateral strength Ratio |
|---|---|---|---|---|---|
| Example 10 | 7.0 | 1.39 | 5.04 | 0.040 | 0.66 |
| Example 11 | 4.0 | 1.39 | 2.88 | 0.032 | 0.57 |
| Example 12 | 7.5 | 1.40 | 5.36 | 0.040 | 1.00 |
| Example 13 | 4.6 | 1.30 | 3.53 | 0.031 | 0.66 |

EXAMPLE 11

A speaker diaphragm was obtained in the same manner as in Example 10, except that an unsaturated polyester solution c shown in Table 1 above was used. The resultant diaphragm was measured for the items described in Example 10. The results are shown in Table 4 above.

EXAMPLE 12

A speaker diaphragm was obtained in the same manner as in Example 10, except that the density of the application of the unsaturated polyester solution d was about 60 to 75 g/m$^2$. The resultant diaphragm was measured for the items described in Example 10. The results are shown in Table 4 above.

EXAMPLE 13

A speaker diaphragm was obtained in the same manner as in Example 10, except that an unsaturated polyester solution e shown in Table 1 above was used. The resultant diaphragm was measured for the items described in Example 10. The results are shown in Table 4 above.

As is apparent from the comparison of Examples 10, 11, and 12 with Example 13, the Young's modulus and the internal loss are significantly improved when using the scaly graphite than when using the earthy graphite. As is apparent from the comparison of Examples 10 and 12 with Example 11, the grain diameter of the scaly graphite is preferably not so large. As is apparent from FIG. 2, the graphite content is preferably 20 to 50 parts by weight for 100 parts by weight of the unsaturated polyester resin.

EXAMPLE 14

Silk staple fibers (fiber length: 58 mm) were randomly collected by the dry method using air flow to form an accumulation layer, and then the fibers were intertwined with one another mechanically by the water flow intertwining method, to obtain a nonwoven fabric having a weight of 30 g/m$^2$. A total of six of such nonwoven fabrics were layered on one another. An unsaturated polyester solution f shown in Table 1 above was applied to both surfaces of the resultant layered structure at a density of about 60 to 75 g/m$^2$, and heat-pressed at 110° C. for one minute using diaphragm-shaped matched die molds. As a result, a speaker diaphragm having a diameter of 20 cm and a thickness of 0.35 mm was obtained.

The Young's modulus, density, specific modulus of elasticity, and internal loss of the resultant diaphragm were measured by normal methods. The results are shown in Table 5 below, together with the results of Examples 15 to 18, which will be described later.

TABLE 5

| | Young's modulus $10^{10}$ dyn/cm$^2$ | Density g/cm$^3$ | Specific modulus of elasticity $10^{10}$ dyn · cm/g | Internal loss tan δ |
|---|---|---|---|---|
| Example 14 | 6.4 | 1.27 | 5.04 | 0.034 |
| Example 15 | 6.3 | 1.21 | 5.21 | 0.041 |
| Example 16 | 5.7 | 1.16 | 4.91 | 0.040 |
| Example 17 | 6.4 | 1.23 | 5.20 | 0.031 |
| Example 18 | 3.5 | 1.20 | 2.92 | 0.030 |

EXAMPLE 15

A speaker diaphragm was obtained in the same manner as in Example 14, except that an unsaturated polyester solution g shown in Table 1 above was used. The resultant diaphragm was measured for the items described in Example 14. The results are shown in Table 5 above.

Figure 3:
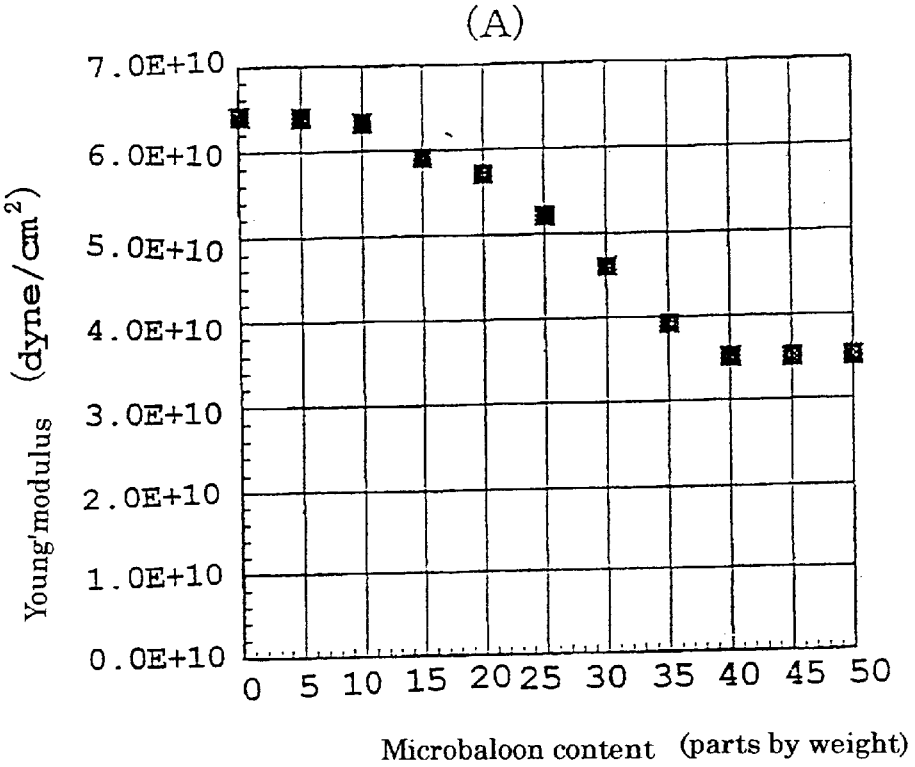
FIG. 3A is a graph showing the relationship between the content of microbaloons in a thermosetting resin composition used in the present invention and the Young's modulus of the resultant product.
FIG. 3B is a graph showing the relationship between the content of microbaloons in the thermosetting resin composition and the internal loss of the resultant product.
Figure 3:
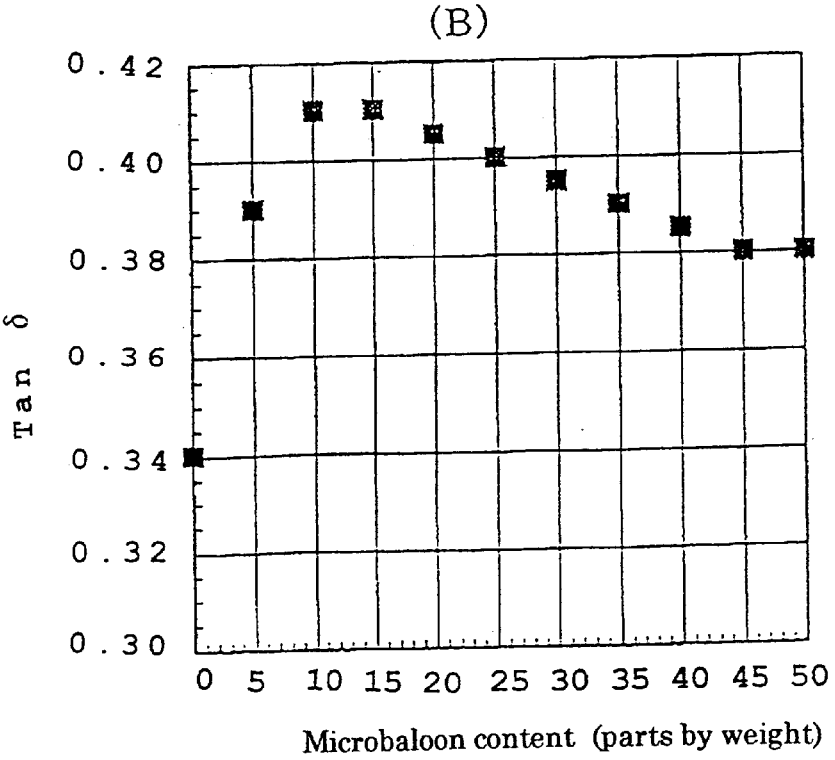

In addition, diaphragms were produced by varying the content of hollow spheres (microbaloons) in the unsaturated polyester solution g, and the Young's modulus and the internal loss of the diaphragms were measured. The relationship between the balloon content and the Young's modulus is shown in FIG. 3A, and the relationship between the balloon content and the internal loss is shown in FIG. 3B.

EXAMPLE 16

A speaker diaphragm was obtained in the same manner as in Example 14, except that an unsaturated polyester solution h shown in Table 1 above was used. The resultant diaphragm was measured for the items described in Example 14. The results are shown in Table 5 above.

EXAMPLE 17

A speaker diaphragm was obtained in the same manner as in Example 14, except that an unsaturated polyester solution i shown in Table 1 above was used. The resultant diaphragm was measured for the items described in Example 14. The results are shown in Table 5 above.

EXAMPLE 18

A speaker diaphragm was obtained in the same manner as in Example 14, except that the unsaturated polyester solution a was used. The resultant diaphragm was measured for the items described in Example 14. The results are shown in Table 5 above.

As is apparent from Table 5, all the speaker diaphragms of Examples 14 to 18 exhibited excellent characteristics. Further, it is found that the use of microbaloons lowers the density (reduces the weight) while maintaining the excellent Young's modulus, specific modulus of elasticity, or internal loss.

As is apparent from FIGS. 3A and 3B, the balloon content is preferably in the range of 5 to 20 parts by weight in consideration of the balance between the Young's modulus and the internal loss.

Industrial Applicability

The speaker diaphragm of the present invention obtained by impregnating a nonwoven fabric formed of a fiber material containing protein fibers with an unsaturated polyester resin composition has excellent acoustic characteristics. The use of the unsaturated polyester resin allows for production of the speaker diaphragm with excellent workability.

Many other modifications will be apparent to and be readily practiced by those skilled in the art without departing from the scope and spirit of the invention. It should therefore be understood that the scope of the appended claims is not intended to be limited by the details of the description but should rather be construed broadly.

What is claimed is:

1. A speaker diaphragm comprising one or more layers of nonwoven fabric, the nonwoven fabric layer being impregnated with a thermosetting resin composition, wherein at least one of the nonwoven fabric layers is formed of nonwoven fabric made of a fiber material comprising silk fibers made of a natural silk, wherein a content of sericin in the silk fibers is 1% by weight or less, and wherein the thermosetting resin composition comprises an unsaturated polyester resin as a main component.

2. A speaker diaphragm according to claim 1, wherein the silk fibers are produced by boiling a natural silk in alkalescent hot water.

3. A speaker diaphragm according to claim 1, wherein the silk fibers have a fineness from 0.8 to 1.2 denier.

4. A speaker diaphragm according to claim 1, wherein the speaker diaphragm comprises a plurality of nonwoven layers and the plurality of nonwoven fabric layers comprise a nonwoven fabric layer formed of the silk fibers and a nonwoven fabric layer formed of organic fibers having a high modulus of elasticity.

5. A speaker diaphragm according to claim 4, wherein the organic fibers having a high modulus of elasticity are meta-aramid fibers or para-aramid fibers.

6. A speaker diaphragm according to claim 4, wherein the nonwoven fabric layer formed of the silk fibers and the nonwoven fabric layer formed of the organic fibers having a high modulus of elasticity are layered alternately.

7. A speaker diaphragm according to claim 1, wherein the nonwoven fabric is meshed.

8. A speaker diaphragm according to claim 1, wherein the thermosetting resin composition comprises a scaly mineral.

9. A speaker diaphragm according to claim 8, wherein the scaly mineral is graphite.

10. A speaker diaphragm according to claim 9, wherein the graphite has a mean grain diameter in a range of 4 to 10 $\mu$m.

11. A speaker diaphragm according to claim 8, wherein the scaly mineral is comprised in a range of 20 to 50 parts by weight for 100 parts by weight of the unsaturated polyester resin.

12. A speaker diaphragm according to claim 8, wherein the thermosetting resin composition further comprises microbaloons.

13. A speaker diaphragm according to claim 12, wherein the microbaloons are selected from the group consisting of organic microbaloons containing a vinylidene chloride—acrylonitrile copolymer as a main component and inorganic microbaloons containing borosilicate glass as a main component.

14. A speaker diaphragm according to claim 12, wherein the microbaloons are comprised in a range of 5 to 20 parts by weight for 100 parts by weight of the unsaturated polyester resin.

15. A speaker diaphragm comprising a plurality of nonwoven layers that are impregnated with a thermosetting resin composition, wherein the plurality of nonwoven fabric layers comprise a nonwoven fabric layer formed of silk fibers and a nonwoven fabric layer formed of organic fibers having a high modulus of elasticity, wherein the thermosetting resin composition comprises an unsaturated polyester resin as a main component, and wherein the organic fibers having a high modulus of elasticity are meta-aramid fibers or para-aramid fibers.

* * * * *